United States Patent [19]

Hempelmann et al.

[11] Patent Number: 5,010,857

[45] Date of Patent: Apr. 30, 1991

[54] ROCKER ARM

[75] Inventors: Heinrich J. Hempelmann, Farmington Hills; Eugene P. Manier, Canton, both of Mich.

[73] Assignee: NI Industries, Inc., Novi, Mich.

[21] Appl. No.: 567,829

[22] Filed: Aug. 15, 1990

[51] Int. Cl.[5] ..... F01L 1/18

[52] U.S. Cl. ..... 123/90.39; 123/90.41; 74/519; 74/559

[58] Field of Search ..... 123/90.39, 90.4, 90.41, 123/90.42, 90.44, 90.45, 90.47; 74/519, 559

[56] References Cited

U.S. PATENT DOCUMENTS

| | | | |
|---|---|---|---|
| 1,449,611 | 3/1923 | Konigslow | 123/90.39 |
| 2,176,083 | 10/1939 | Leake | 123/90.39 |
| 2,199,914 | 5/1940 | Haberstump | 123/90.39 |
| 2,272,166 | 2/1942 | Leake | 74/519 |
| 2,288,831 | 7/1942 | O'Harrow | 123/90.39 |
| 2,338,726 | 1/1944 | Leake | 123/90.39 |
| 2,385,309 | 9/1945 | Spencer | 123/90.39 |
| 2,478,130 | 8/1949 | Ronfeldt | 123/90.39 |
| 2,522,326 | 9/1950 | Winter, Jr. | 123/90.39 |
| 2,905,160 | 9/1959 | Sampietro | 123/90.39 |
| 3,020,779 | 2/1962 | Winter, Jr. | 123/90.39 |
| 3,096,749 | 7/1963 | Davidson | 74/559 |
| 3,222,950 | 12/1965 | Winter, Jr. | 123/90.39 |
| 3,374,690 | 3/1968 | Hirose | 74/519 |
| 3,418,985 | 12/1968 | Hirose | 123/90.39 |
| 4,132,196 | 1/1979 | Wherry | 123/90.39 |
| 4,430,783 | 2/1984 | Wherry | 123/90.39 |
| 4,872,429 | 10/1989 | Anderson et al. | 123/90.44 |

FOREIGN PATENT DOCUMENTS

| | | | |
|---|---|---|---|
| 0020509 | 2/1982 | Japan | 123/90.39 |
| 0272903 | 11/1988 | Japan | 123/90.39 |

*Primary Examiner*—Charles J. Myhre
*Assistant Examiner*—Weilun Lo
*Attorney, Agent, or Firm*—Harness, Dickey & Pierce

[57] ABSTRACT

A rocker arm is formed from a unitary sheet metal material with a unitary journal and pad with selective welds to provide rigidity.

14 Claims, 2 Drawing Sheets

ROCKER ARM

BACKGROUND AND SUMMARY OF THE INVENTION

The present invention relates to rocker arms and, more particularly, to a simplified rocker arm and a method of manufacturing same from sheet metal.

Rocker arms are associated with push rods and valve stems for the purpose of opening and closing the valves of various types of engines. Although there are numerous types of rocker arms, the industry is constantly trying to devise simpler, more reliable, and stronger rocker arms which can be produced in a cost effective manner. The present invention seeks to achieve this goal, and in the same time provide a rocker arm formed from a unitary piece of sheet metal.

Other advantages of the present invention will be readily appreciated when it becomes better understood by reference to the following detailed description and accompanying drawings.

DETAILED DESCRIPTION OF THE PREFERRED EMBODIMENT

Figure 1:
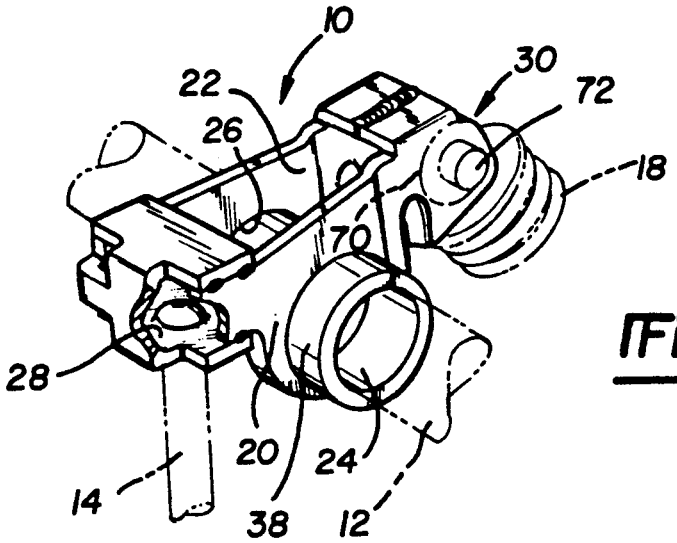
FIG. 1 is a perspective view of a rocker arm, with a portion broken away, embodying the principles of the present invention.

There is illustrated in FIG. 1 a rocker arm 10 adapted for pivotal movement about the usual rocker shaft 12 in response to movement of the usual push rod 14. As the push rod 14 moves upwardly, the rocker arm 10 pivots about shaft 12 forcing valve stem 16 downwardly which, in turn, opens the valve (not shown). Upon removal of the force on the push rod 14, a valve spring 18 pushes the valve stem 16 upwardly to close the valve and to pivot the rocker arm 10 about the shaft 12 to urge the push rod 14 down. The cycle then repeats.

Figure 2:
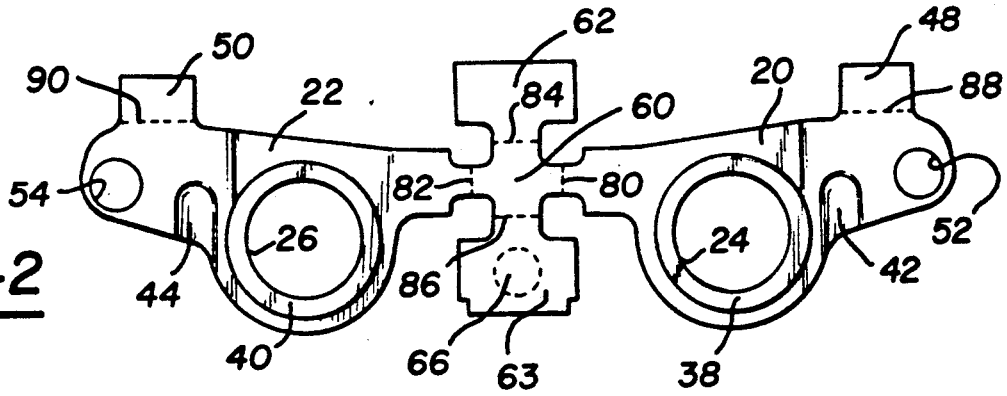
FIG. 2 is an elevation view of a piece of sheet metal blank from which the rocker arm of FIG. 1 is made.
Figure 3:
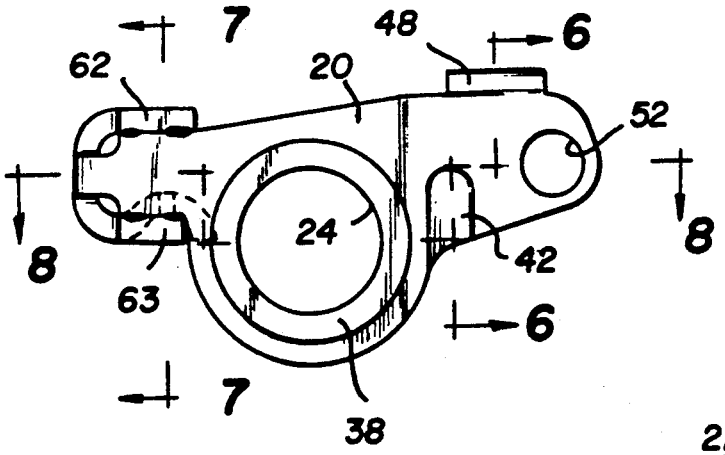
FIG. 3 is a side elevation view of the rocker arm of FIG. 1.

The rocker arm 10 is formed from a unitary sheet metal stamping or blank of the configuration illustrated in FIG. 2. The stamping is bent, worked and welded into the rocker arm 10, as will be explained herein. As seen in FIG. 1, the finished rocker arm 10 includes a pair of generally parallel substantially identical sidewalls 20 and 22 having aligned coaxial apertures 24 and 26 defined by integral circumferential flanges 38 and 40, respectively, which form a hub or journal to receive the shaft 12, a pad 28 to receive force from the push rod 14 and a roller follower mechanism 30 to contact and exert force on the valve stem 16.

Figure 4:
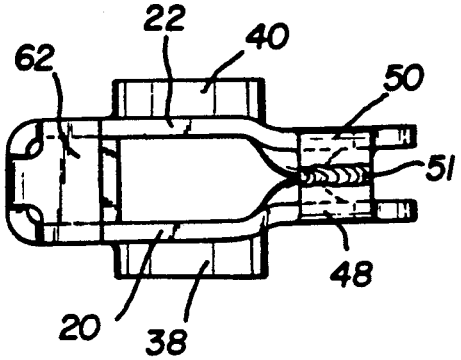
FIG. 4 is a top plan view of the rocker arm of FIG. 1.
Figure 6:
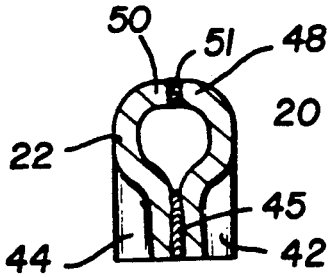
FIG. 6 is a sectional view taken along line 6—6 of FIG. 3.
Figure 8:
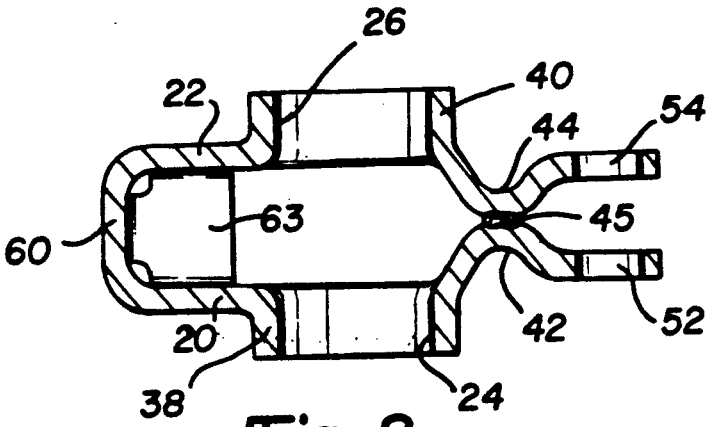
FIG. 8 is a sectional view taken along line 8—8 of FIG. 3.

Indentations or pinches 42 and 44, best seen in FIGS. 2 and 8, are formed in sidewalls 20 and 22 adjacent to apertures 24 and 26, respectively, to add rigidity to the rocker arm 10. The inner portions of the indentations or dimples 42 and 44 abut one another and are welded together at point 45 to further increase the rigidity of the rocker arm 10, as seen in FIG. 6. For the same purpose, integral fingers 48 and 50 extend toward one another from the upper surface of sidewalls 20 and 22, and are welded to one another by a butt weld 51, as best seen in FIG. 4. Apertures 52 and 54 are formed in sidewalls 20 and 22, respectively, adjacent the ends of the blanks to receive a roller mechanism at the open end of the rocker arm.

Figure 5:
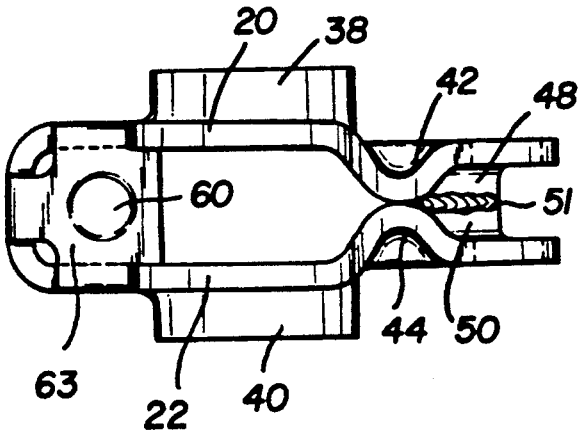
FIG. 5 is a bottom plan view of the rocker arm of FIG. 1.
Figure 7:
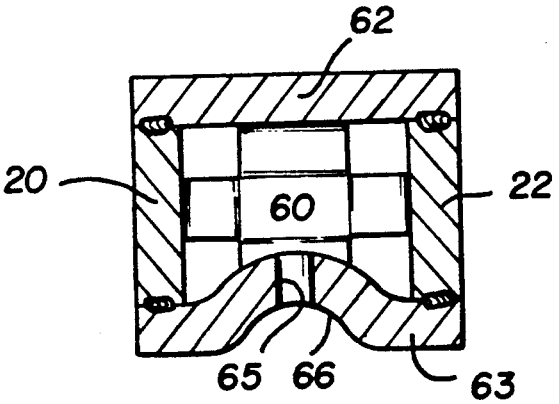
FIG. 7 is a sectional view taken along line 7—7 of FIG. 3.

The closed end of the rocker arm is defined by an integral bridging element 60 and a pair of integral tabs 62 and 63 which are folded over and welded at their opposite side edges to sidewalls 20 and 22, as best shown in FIGS. 1, 3, 5 and 7, thus providing a very rigid end structure. Tab 63 is provided with an indentation or dimple 66 to define pad 28 for receiving the push rod 14, as best seen in FIGS. 5 and 7. The indentation 66 of pad 28 is a hemispherical surface coined or stamped into tab 63 and is provided with a small hole 65 to provide access for a lubricant to flow into indentation 66.

The roller follower mechanism 30 generally includes a roller 70 rotatably supported by a pin 72 which is press fit into the apertures 52 and 54 of sidewalls 20 and 22. The roller 70 is adapted to contact the valve stem 16.

The rocker arm of the present invention is manufactured by the following process. A piece of sheet metal is stamped or formed into a blank as illustrated in FIG. 2. The blank has an overall eyeglass frame shape with extending wings. The apertures 24 and 26, radial flanges 38 and 40, indentations 40 and 42, and indentation 66 are stamped or formed into the layout during the original forming of the blank. The bore 65 can be drilled into tab 63 at any time. With reference to FIG. 2, sidewalls 20 and 22 are folded about lines 80 and 82, tabs 62 and 63 about fold lines 84 and 86, and fingers 48 and 50 about fold lines 88 and 90, as can be readily visualized. Each of the elements is thereafter welded in the manner described. The roller follower mechanism 30 is then assembled to the blank to complete the process.

The present invention has been described in an illustrated manner and it is to be understood that the terminology which has been used is intended to be in the nature of description rather than of limitation. Obviously, modifications and variations of the present invention are possible in light of the above teachings. It is, therefore, to be understood that within the scope of the appended claims, the present invention may be practiced otherwise than as specifically described.

What is claimed is:

1. A rocker arm formed from a one-piece sheet metal blank, a pair of sidewalls opposing one another, said pair of sidewalls each defining an aperture, said apertures being positioned coaxial with one another with an integral circumferential flange extending from each sidewall about said aperture therein to define a shaft journal;

an end wall integral with and interconnecting said side walls at one end thereof;

at least one integral finger extending transversely from each said sidewall towards the other said side wall, the ends of said fingers being welded together to rigidify said rocker arm;

force receiving means adjacent one end of said rocker arm adapted to engage a push rod or the like; and force exerting means at the opposite end of said rocker arm than said force exerting means and adapted for contacting a valve stem or the like to activate same.

2. A rocker arm as claimed in claim 1 wherein said integral fingers are disposed adjacent the opposite end of said sidewalls from said end wall.

3. A rocker arm as claimed in claim 2 wherein said force receiving and exerting means are disposed on the lower portion of said rocker arm and said integral fingers are disposed on the upper surface of said rocker arm.

4. A rocker arm as claimed in claim 1 wherein said circumferential flanges extend outwardly from said rocker arm.

5. A rocker arm as claimed in claim 1 further comprising a tab formed integrally with said end wall and having opposite side edges welded to each of said side walls respectively.

6. A rocker arm as claimed in claim 5 wherein said tab is disposed on the upper surface of said rocker arm.

7. A rocker arm as claimed in claim 5 further comprising a second tab formed integrally with said end wall and having opposite side edges welded to each of said side walls respectively.

8. A rocker arm as claimed in claim 7 wherein said second tab is disposed on the lower surface of said rocker arm.

9. A rocker arm as claimed in claim 8 wherein said force receiving means is disposed on said second tab.

10. A rocker arm as claimed in claim 9 wherein said force receiving means is an upwardly projecting dimple in said second tab.

11. A rocker arm as claimed in claim 9 wherein said dimple has a bore therethrough defining a lubricant passage.

12. A rocker arm as claimed in claim 1 wherein each of said sidewalls has an inwardly projecting dimple, said dimples being aligned with one another and having their inner surfaces welded together to further rigidify said rocker arm.

13. A rocker arm as claimed in claim 12 wherein said dimples are disposed between said shaft journal and said force exerting means.

14. A rocker arm as claimed in claim 1 wherein said force exerting means includes transversely aligned openings in said sidewalls, and roller means rotatively disposed in said openings.

* * * * *